US007770610B2

(12) United States Patent
Lisle

(10) Patent No.: US 7,770,610 B2
(45) Date of Patent: Aug. 10, 2010

(54) SYSTEM AND METHOD FOR IN-STRUCTURE DELIVERY OF AIR FOR FILLING OF BREATHING APPARATUS

(75) Inventor: Richard W. Lisle, Las Vegas, NV (US)

(73) Assignee: Mechanical Contractors Association, Inc., Las Vegas, NV (US)

( * ) Notice: Subject to any disclaimer, the term of this patent is extended or adjusted under 35 U.S.C. 154(b) by 845 days.

(21) Appl. No.: 11/703,334

(22) Filed: Feb. 6, 2007

(65) Prior Publication Data

US 2007/0163578 A1 Jul. 19, 2007

(51) Int. Cl.
*A62B 7/00* (2006.01)
*B65B 31/00* (2006.01)

(52) U.S. Cl. ..... 141/54; 141/18; 141/94; 141/197; 141/236; 141/237; 128/202.13; 128/202.25

(58) Field of Classification Search ..... 141/18, 141/47, 54, 94, 197, 236, 237; 128/202.13, 128/205.25
See application file for complete search history.

(56) References Cited

U.S. PATENT DOCUMENTS 2,299,793 A * 10/1942 Cannaday et al. ..... 128/202.13
4,331,139 A * 5/1982 Popa ..... 128/202.13
4,380,187 A * 4/1983 Wicks ..... 454/342
4,467,796 A 8/1984 Beagley
4,862,931 A 9/1989 Vella
5,570,685 A 11/1996 Turiello
5,720,659 A * 2/1998 Wicks ..... 454/256
5,800,260 A * 9/1998 Kao ..... 128/202.13
6,832,952 B2 * 12/2004 Faltesek et al. ..... 128/204.16
7,527,056 B2 * 5/2009 Turiello ..... 128/205.26
7,621,269 B2 * 11/2009 Turiello ..... 128/204.21
2008/0041376 A1 2/2008 Turiello
2008/0041377 A1 2/2008 Turiello
2008/0041378 A1 2/2008 Turiello
2008/0041379 A1 2/2008 Turiello

OTHER PUBLICATIONS

Bauer Compressors "High Pressure Briefcase Fill Station", Oct. 2002, 1 page.

* cited by examiner

*Primary Examiner*—Gregory L Huson
*Assistant Examiner*—Nicolas A Arnett
(74) *Attorney, Agent, or Firm*—Weide & Miller, Ltd.

(57) ABSTRACT

An in-structure air delivery system comprises a control panel and a plurality of air delivery lines. The control panel is located at a first location in the structure and has an air supply inlet. Each air delivery line extends from the control panel to a different location in the structure. Valves are configured to selectively control the flow of air through each of the air delivery lines. In a method of use, a high pressure air supply such as a portable compressor is connected to the inlet of the system. Air is selectively delivered to one or more of the delivery lines. A control unit is connected to the outlet of the delivery line. Air is supplied to the control unit. The control unit is used to regulate the flow of air to a component of breathing equipment, such as to a firefighter's breathing equipment air cylinder to be re-filled.

10 Claims, 3 Drawing Sheets

SYSTEM AND METHOD FOR IN-STRUCTURE DELIVERY OF AIR FOR FILLING OF BREATHING APPARATUS

FIELD OF THE INVENTION

The present invention relates to a system and method for delivering air for the filling of breathing apparatus, such as air cylinders for use with fire-fighter breathing equipment, in a structure.

BACKGROUND OF THE INVENTION

Firefighters and other personnel must often utilize air breathing apparatus when addressing situations in structures. For example, due to smoke in a building, firefighters must don breathing equipment which includes air tanks and masks.

In large structures, including high-rises, this is problem. In particular, by the time a firefighter travels deep into the structure, their air tank(s) may be substantially empty. As such, air tanks must be carried into the building to create one or more staging areas for firefighters to replace empty tanks. This is labor intensive and time consuming, reducing the effort which available manpower can devote to the fire.

Recently, breathing air replenishment systems have been developed. The existing systems have a number of drawbacks. These drawbacks relate to system complexity and reliability. For example, one proposed system relies upon an "in-series" fill station structure. In the event of a break in the system, however, air delivery may be interrupted throughout the entire building. This might occur in the event of an explosion or other damage to the structure. In addition, the systems generally require complex fill stations at various points in the structure. This greatly increases the cost of installation of the system.

It is desired to provide a simple and reliable in-structure air breathing apparatus replenishment system.

SUMMARY OF THE INVENTION

The invention comprises an in-structure system and method for delivering air or other gas to a breathing apparatus.

In one embodiment, the system comprises a control panel and a plurality of air delivery lines. The control panel is located at a first location in the structure, the control panel including an air supply inlet.

Each air delivery line preferably extends from the control panel to a different location in the structure. In one embodiment, for example, a first delivery line may extend from the control panel to one floor of the structure. A second delivery line may extend from the control panel to another floor of the structure.

One or more valves or other controls are configured to selectively control the flow of air through each of the air delivery lines. In one embodiment, a first valve is associated with each air delivery line at the control panel, and a second valve is associated with each air delivery line at its outlet or port.

In one embodiment, pressure sensors and indicators may be associated with the air delivery lines for indicating a pressure in those lines. The system may be charged with air under pressure. If a pressure of the air falls below a minimum level, the indicator associated with the delivery line may so indicate.

In a method of use, a high pressure air supply is connected to the inlet of the system. The high pressure air supply may comprise a portable compressor, such as a fire truck mounted air compressor. Air is selectively delivered to one or more of the delivery lines. A control unit is connected to the outlet of the delivery line. Air is supplied to the control unit. The control unit is used to regulate the flow of air to a component of breathing equipment, such as to an air cylinder to be re-filled.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One aspect of the invention is a system for delivering air to one or more locations of a structure. Preferably, the system is configured to deliver air for filling breathing apparatus, such as firefighters breathing equipment. Another aspect of the invention is a method of delivering air to a structure, including to a breathing apparatus.

Figure 1:
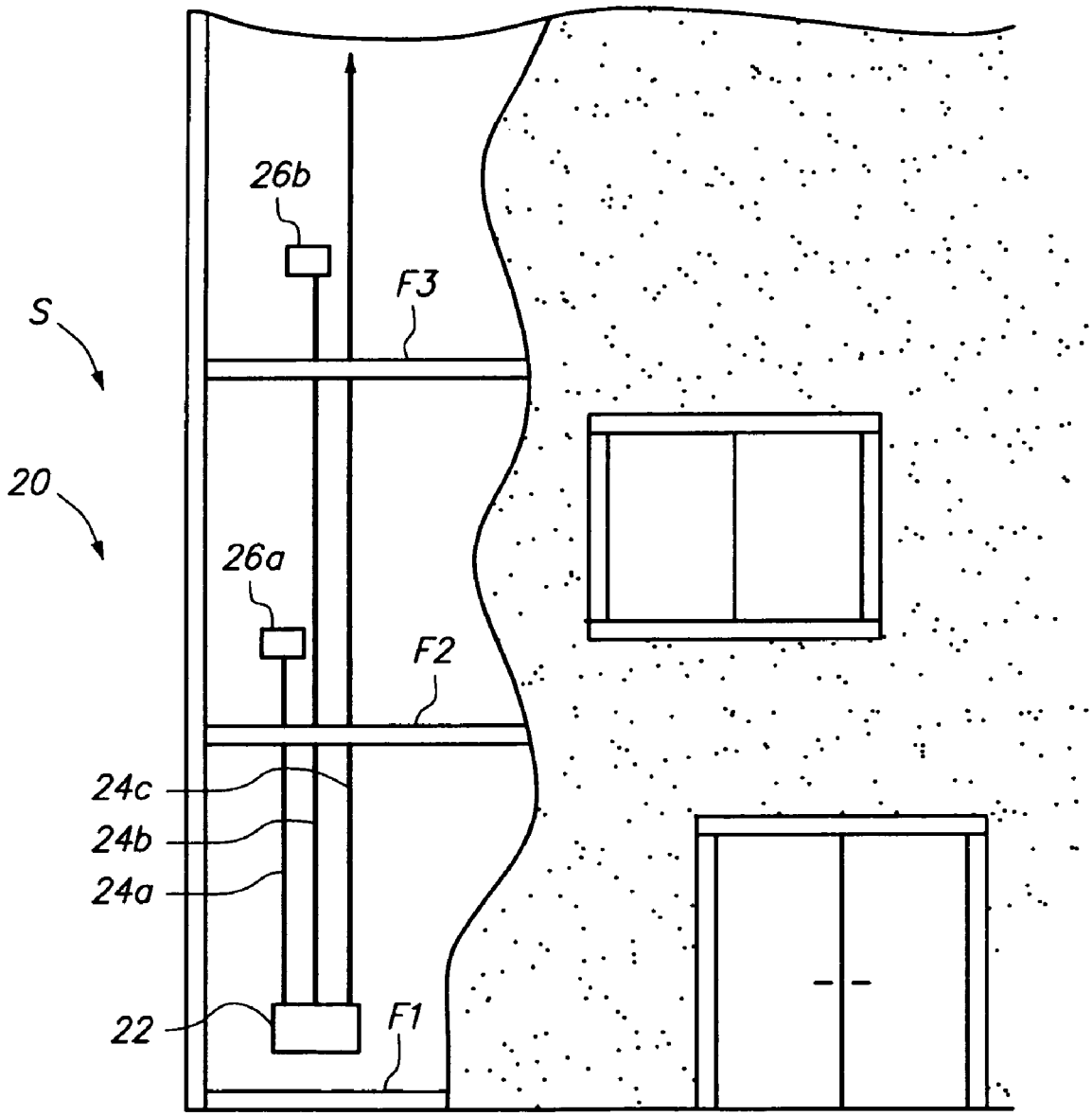
FIG. 1 illustrates a system of the invention associated with a structure.

One configuration of a system of the invention will be described first with reference to FIGS. 1 and 2. FIG. 1 illustrates one environment of use of a system of the invention, that being a structure S. The structure may be of a variety of types. As illustrated, the structure S is a building having multiple floors or stories F1, F2, F3. The structure S as illustrated has three floors, but the structure S could have a variety of configurations (such as being only a single story or floor, or being of a variety of stories or floors). The portions of the structure could be above and/or below ground.

As illustrated in FIG. 1, the system 20 comprises a control panel 22 and one or more air delivery lines 24*a*, 24*b*, 24*c*. In general, each air delivery line 24*a*, 24*b*, 24*c* has a first end located at the control panel 22 and a second end 26 comprising a terminus or port. In a preferred embodiment, an air delivery line extends from the control panel 22 to each of one or more desired locations within the structure to which it is desired to deliver air. In the example illustrated, a first air delivery line 24*a* extends from the control panel 22 to a location on the second floor F2 of the structure S. A second air delivery line 24*b* extends from the control panel 22 to a location on the third floor F3 of the structure S. The third air delivery line 24*c* may extend to yet another location of the structure S, such as yet another floor thereof.

Of course, the various locations to which the air lines extend may vary. As described below, in a preferred method of the invention, pressurized air is supplied from a vehicle to the control pane 122. Thus, in one embodiment, the control panel 22 is preferably located in an area of the structure which is accessible from the exterior. For example, the control panel 22 may be located in an area of the structure S near a door. The control panel 22 might also be located in an access panel which is accessible from the exterior of the structure, at a lower level parking area, or other locations.

Figure 2:
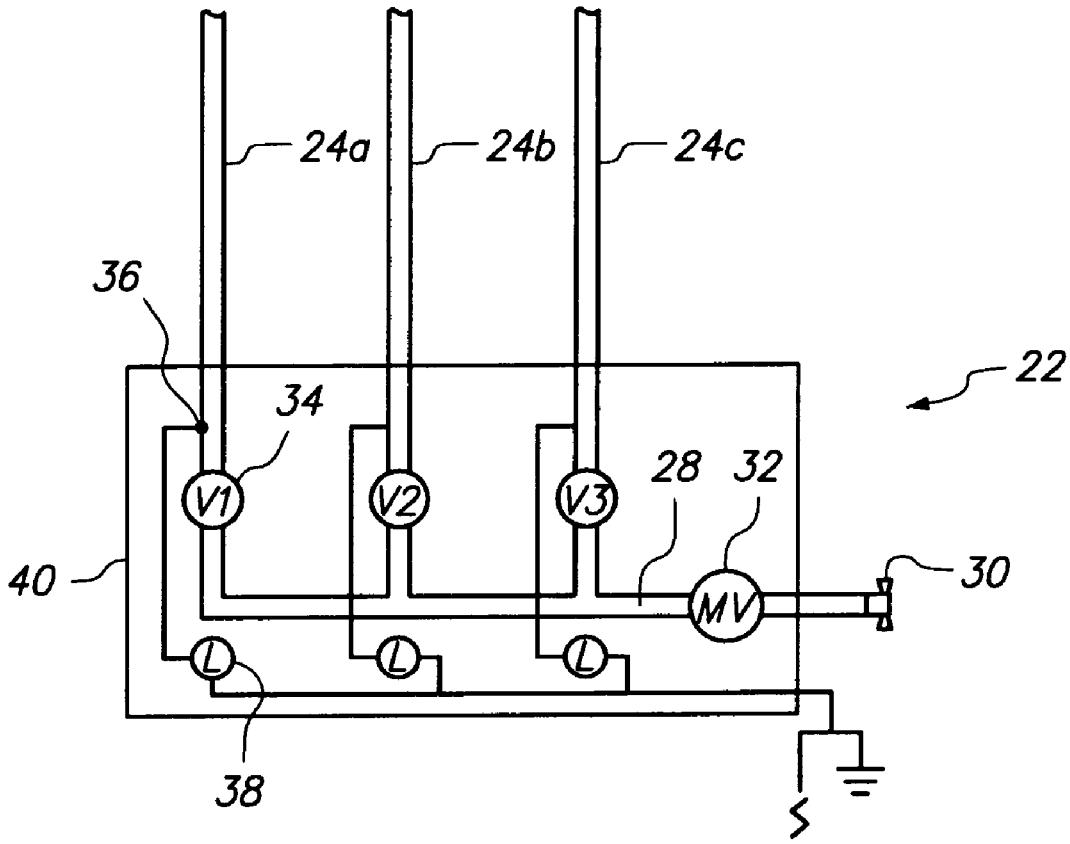
FIG. 2 illustrates a control panel portion of the system illustrated in FIG. 1.

FIG. 2 illustrates one embodiment of a control panel 22 of the invention in greater detail. In one embodiment, the control panel 22 comprises at least one air supply line leading to the one or more air delivery lines 24*a*, 24*b*, 24*c*. In one embodiment, a single air supply line is configured as a manifold 28. The manifold 28 has a first end comprising an air inlet 30. Each air delivery line 24*a*, 24*b*, 24*c* communicates with the manifold 28. As illustrated, the air delivery lines 24*a*, 24*b*, 24*c* may connect to the manifold 28 along a length thereof.

As detailed below, an air supply may preferably be connected to the air inlet 30. In one embodiment, the air inlet 30 may thus include one or more connectors for mating with connectors of an air supply line, such as an air supply hose.

In one embodiment, means are provided for controlling the flow of air through the manifold 28 between the air inlet 30 and the one or more air delivery lines 24*a*, 24*b*, 24*c*. In one embodiment, this means comprises a master valve 32. The master valve 32 may be of a variety of types and may be manually or automatically operated (such as by a servo-motor). Preferably, the valve 32 can be placed into a first position in which air can not flow there through to a second position in which air can flow there through.

Preferably, means are also provided for selectively controlling the flow of air from the manifold 28 through each air delivery line 24*a*, 24*b*, 24*c*. In one embodiment, this means could comprise valves associated with the manifold 28 and placed along the manifold 28 between the air delivery line connections. In the embodiment illustrated, the means comprises a valve 34 which is associated with each air delivery line 24*a*, 24*b*, 24*c*. Each valve 34 may again be of a variety of types and may be manually or automatically operated. Each valve 34 can be moved between open and closed positions, thus controlling the flow of air through each air delivery line 24*a*, 24*b*, 24*c*.

In one embodiment, the control panel 22 also includes means for sensing or detecting an air pressure in each air delivery line 24*a*, 24*b*, 24*c*. The means may comprise a pressure sensor 36 associated with each air delivery line 24*a*, 24*b*, 24*c*. The pressure sensor 36 is preferably configured to provide an output indicative of an air pressure in the air delivery line 24*a*, 24*b*, 24*c*. In one embodiment, means are provided for indicating the pressure in each air delivery line 24*a*, 24*b*, 24*c*. This means may comprise one or more displays, such as LCD displays, which indicate the pressure (such as in psi, bars, atm or other units). In a preferred embodiment, the means comprises a light 38. The light 38 is preferably configured to provide an indication of air pressure. In one embodiment, the light 38 illuminates if the air pressure in the corresponding line meets a required minimum pressure, such as 100 psi. In another embodiment, the light illuminates if the air pressure in the corresponding line does not meet a required minimum pressure. In yet another embodiment, the light 38 may illuminate in different colors depending on the air pressure. Of course, a wide variety of indicators may be utilized to provide information regarding air pressure. These indicators may include alarms, such as illuminated or audible alarms, such as to indicate an undesired air pressure condition.

In one embodiment, the control panel 22 also includes a housing 40. The housing 40 may define an interior area which houses the various valves, pressure sensors and indicators. Access to the interior of the housing 40 may be via a door or the like (not illustrated). Such a door may be lockable to prevent unauthorized parties from accessing the interior thereof. Of course, the housing 40 may also be defined by a portion of the structure S, such as an inset wall area or the like.

Figure 3:
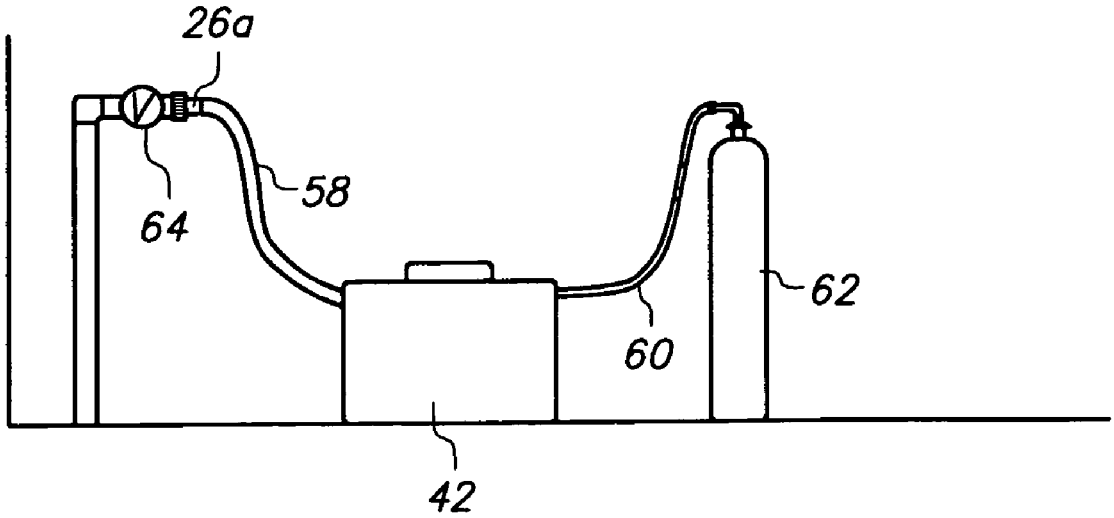
FIG. 3 illustrates an air delivery line outlet of the system illustrated in FIG. 1, with a control unit and air tank connected thereto.

Each air delivery line preferably leads from the control panel 22, and thus the air supply, to an outlet or port. FIG. 3 illustrates the outlet or port 26*a* corresponding to the first air delivery line 24*a*. The port 26*a* may include one or more fittings for mating to corresponding fittings of other elements, such as a supply line, as detailed below. In one embodiment, a valve 64 is located adjacent the port. The valve 64 can be selectively controlled to permit the flow of air through the port. Preferably, the valve 64 is normally in a closed position, thus permitting the air delivery line to be charged with a minimum air pressure during non-use conditions.

The air delivery lines may be routed in various fashions through the structure S. The port of each air delivery line may be located in a particular location, such as a fill panel in a wall, a closet or other location of the structure. Access to the port may be controlled.

Preferably, air may be supplied through each air delivery line to the outlet or port thereof. This air may be provided to a breathing apparatus, or a component thereof. For example, the air may be utilized to pressurize or re-fill an air tank or cylinder, such as a portable air tank for supplying a firefighter's breathing apparatus.

In one embodiment, means are provided for controlling the delivery of air from the air delivery line outlet to the breathing apparatus, such as air tank. Referring to FIG. 3, in one embodiment, this means may comprise a control unit 42.

Figure 4:
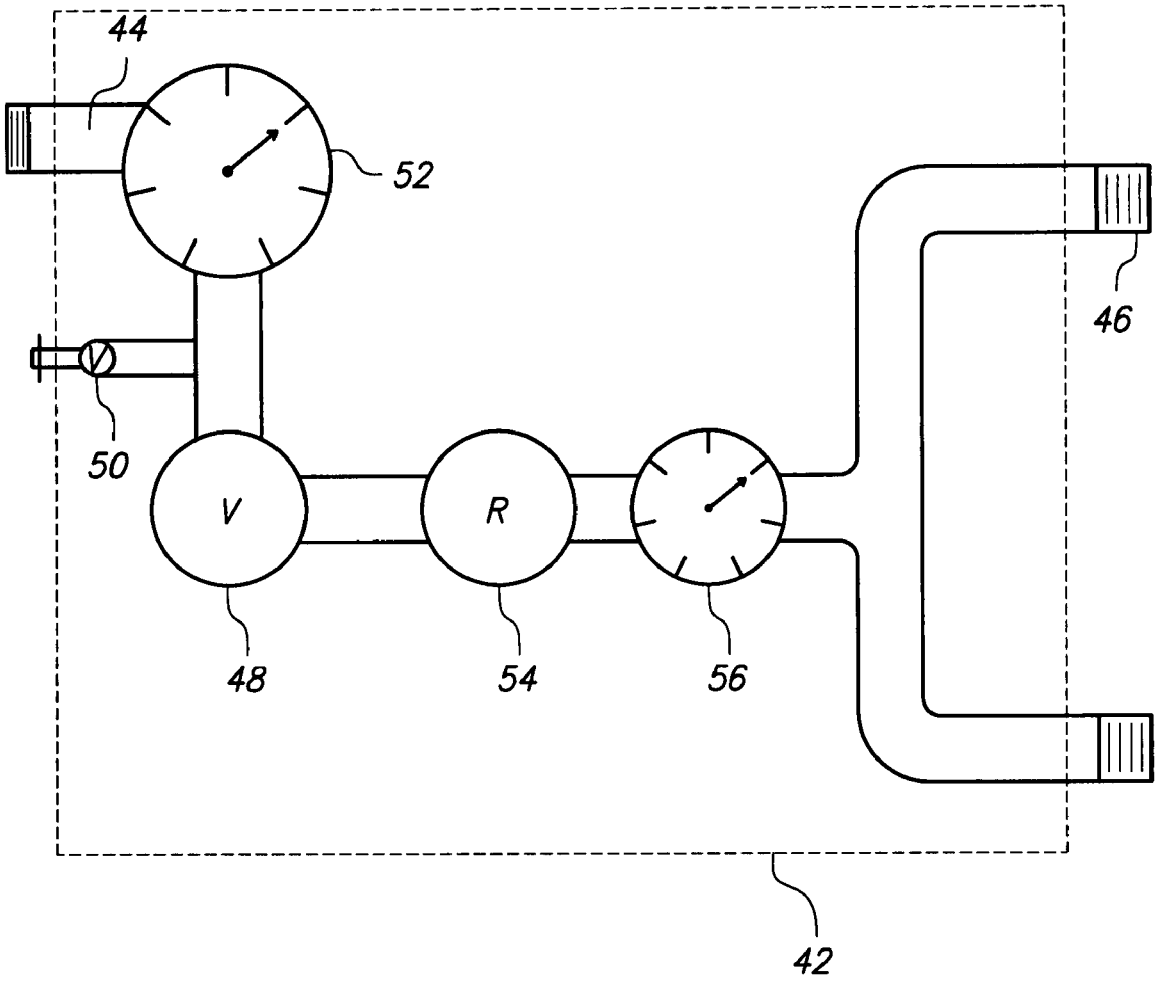
FIG. 4 schematically illustrates an embodiment of the control unit illustrated in FIG. 4.

FIG. 4 illustrates one embodiment of the control unit 42 in greater detail. As illustrated, the control unit 42 defines one or more pathways, such air lines, from an inlet 44 to one or more outlets 46. As illustrated, a control valve 48 is provided between the inlet 44 and one or more outlets 46 for controlling the flow of air through the unit 42. A bleed valve 50 may be provided at the inlet side of the control valve 48 for bleeding or relieving high pressure air. In one embodiment, an inlet air pressure gauge 52 is provided for indicating the air pressure between in the inlet 44 and control valve 48.

A regulator 54 is provided between the control valve 48 and the one or more outlets 46. The regulator 54 preferably controls the outlet air pressure. A regulated air pressure gauge 56 is preferably provided between the regulator 54 and the one or more outlets 46. The regulated air pressure gauge 56 preferably provides information regarding the air pressure between the regulator 54 and the one or more outlets 46.

In one embodiment, the components of the control unit 42 are located in a case or housing. For example, the housing may be suitcase sized, and include a handle or rollers so that the unit 42 is portable. In one embodiment, the inlet 44 and one or more outlets 46 are configured with appropriate fittings or the like for connection of one or more other elements. One example of a control unit just described is the High Pressure Briefcase Fill Station available from Bauer Compressors, Inc. of Norfolk, Va.

As illustrated in FIG. 3, in use, a supply line 58 may be connected between the outlet of the air delivery line and the inlet of the control unit 42. A similar line 60 may be connected to one of the outlets 46 of the control unit 44 and extend to an air tank or cylinder 62. The supply lines 58, 60 may be, for example, high pressure flexible hoses or lines.

One aspect of the invention is a method of installing an air supply system in a structure. In one embodiment, at least one control panel is located in a structure at a first location. An air delivery line is routed from the control panel to a second location in the structure. Other delivery lines may be routed from the control panel to other locations in the structure.

In one embodiment, the valves at each outlet or port are closed, while the valves 34 at the control panel 40 are opened. Air is pressurized into the system (such as by hooking a high pressure air source to the inlet 30). The valves 34 at the control panel 40 are then closed, so as to trap air under high pressure within each of the air delivery lines 24*a*, 24*b*, 24*c*. As detailed, the pressure sensors 36 sense the air pressure in the lines. In one embodiment, so long as the air pressure is maintained above a minimum level, the indicators 38, such as lights, indicate such. If the air pressure falls below the minimum level, the indicators 38 so indicate, such as by changing color. In this manner, the system operator can determine the integrity of the air delivery lines. For example, if a line fails, and indication is so provided and the system can be repaired (thus avoiding such a determination only that the time the system is needed for use).

A method of providing air will now be described. Referring to FIGS. 1-3, a source of air is connected to the system 20. Preferably, this source is portable. The air source may be, for example, a high pressure air compressor. The compressor might be located on a firefighting vehicle. In one embodiment, the firefighting vehicle might be parked adjacent the structure S. A hose or other delivery line may be extended from the compressor to the inlet 30.

The master valve 32 may then be opened to supply high pressure air to the manifold 28. One or more of the valves 34 associated with particular air delivery lines 24*a*, 24*b*, 24*c*, may be opened to provide high pressure air to those lines. The particular valves 34 which are opened will generally depend on the particular location where the high pressure air is needed. For example, in the embodiment illustrated in FIG. 1, if air is needed only on the second floor F2, then only the valve corresponding to the second air delivery line 24*b* needs to be opened.

Users of the system 20 may then obtain air at each outlet or port 26 corresponding to each air delivery line to which air is supplied. In order to obtain the air, the valve 64 at the outlet or port 26 of the air delivery line is opened.

In one embodiment, the air is supplied to the control unit 42. Thus, in one embodiment, the control unit 42 is connected to the outlet or port 26. The user may utilize the control unit 42 to selectively supply air to the one or more outlets or ports 46 thereof, under a pressure regulated by the regulator 54 thereof. In one embodiment, the user utilizes the control unit 42 to fill one or more air cylinders 62.

The system and method may have a variety of configurations. In one embodiment, the air delivery and other lines of the system may be stainless steel. The system may be constructed from other materials, however.

In one embodiment, air is delivered at high pressure to and through the system. The air may be atmospheric air. However, other gasses may be delivered through the system. Thus, as used herein, the term "air" may mean either atmospheric air or other gasses. In one embodiment, the system is configured to deliver gas under pressure, such as 1000-4000 psi, for charging air cylinders.

In a preferred embodiment, when the system is not in use, it is charged with a minimum gas pressure, such as 100 psi. Indicators are provided for indicating whether this minimum charge is maintained. The system need not include such indicators, and/or they may be configured in other manners than as described. For example, manifold might also be charged and a sensor and indicator provided for that portion of the system.

In a preferred embodiment, a control unit is connected to the outlet or port of the delivery line during use. In one embodiment, control units may be stored at or near each outlet or port location. In a preferred embodiment, the control units may be provided by the users of the system, such as firefighters. In other embodiments, it is possible to provide the functionality of the control unit via an outlet control panel which is permanently located at each outlet or port. For example, at each port may be provided a control valve and/or regulator and bleed valve.

In other embodiments, it is possible to utilize the system without a control unit. For example, an air cylinder might be connected to an outlet or port without an intermediate control unit.

In one embodiment, the system may not include a master valve. Also, the system may include a bleed valve between the air inlet and the master valve.

As indicated, in a preferred embodiment, each air line extends from the control panel to a single outlet. It is possible for one or more of the lines to extend or branch to more than one location.

The system and method of the invention have a number of advantages. In a preferred embodiment, the system does not include air storage or a source of high pressure air. Instead, the system comprises an air delivery network. This avoids a building owner having to maintain costly air supply equipment over long periods of time, and reduces the complexity, and thus cost, of the system.

In the preferred embodiment of the system, an air line extends from the control panel to a single outlet or port. In this manner, if one of the air delivery lines is compromised, the other delivery lines may still be usable. For example, in the event of a fire or explosion on the third floor F3 of the structure S illustrated in FIG. 1, the completely separate air delivery lines 24*a*, 24*b* may still be used to deliver air because those lines are separate and apart from the line 24*c* which extends to the third floor.

In the preferred embodiment, the system is configured to be utilized with one or more portable control units. Once again, these units allow for a simpler, and thus less costly, system design. In addition, these control units reduce the maintenance cost of the system. In particular, the control units can be maintained by the parties who use the system, such as firefighters.

It will be under stood that the above described arrangements of apparatus and the method there from are merely illustrative of applications of the principles of this invention and many other embodiments and modifications may be made without departing from the spirit and scope of the invention as defined in the claims.

What is claimed is:

1. An air delivery system for a structure comprising:

a plurality of breathing air device fill ports in a plurality of locations of said structure;

a control panel located at said structure;

a main air supply line having an inlet configured to be connected to a portable high pressure air supply located exterior to said structure, said main air supply line leading to said control panel;

a plurality of dedicated air supply lines, a single air supply line leading from said control panel to each of said air device fill ports; and at least one air supply control located at said control panel, said at least one air supply control configured to selectively place each dedicated air supply line in communication with said main air supply line, whereby each breathing air device fill port is configured to receive a supply of air from said main air supply line solely through the single dedicated air supply line corresponding thereto, as controlled by said at least one air supply control.

2. The air delivery system in accordance with claim 1 wherein each breathing air device fill port comprises an outlet control valve for selectively controlling the flow of air from said corresponding dedicated air supply line through said port.

3. The air delivery system in accordance with claim 1 further comprising a pressure sensor associated with each dedicated air supply line.

4. The air delivery system in accordance with claim 3 wherein said pressure sensors are located at said control panel.

5. The air delivery system in accordance with claim 4 wherein the pressure sensor associated with each dedicated air supply line is located between said at least one air supply control which is configured to control the supply of air from said main air supply line to said dedicated air supply line and said breathing device fill port corresponding to said dedicated air supply line.

6. The air delivery system in accordance with claim 3 further comprising at least one visual indicator corresponding to each pressure sensor, said at least one visual indicator configured to indicate if an air pressure sensed by at least one pressure sensor is below a minimum pressure.

7. The air delivery system in accordance with claim 1 further comprising at least one portable control unit, said portable control unit comprising a housing, a least one inlet configured for connection to one of said breathing device air fill ports, at least one outlet configured to connect to a breathing air device, and at least one controller located in said housing and configured to control the flow of air through said portable breathing device air fill controller from said inlet to said outlet thereof.

8. The air delivery system in accordance with claim 1 further comprising a manifold located in said control panel, said main air supply line in communication with said manifold and each dedicated air supply line in selective communication with said manifold, whereby air provided through said main air supply line may selectively be delivered to each dedicated air supply line as controlled by said at least one air supply control.

9. The air delivery system in accordance with claim 1 wherein said plurality of breathing device air fill ports comprise a first breathing device air fill port, a second breathing device air fill port and a third breathing device air fill port, and wherein a first dedicated air supply line leads from said control panel to said first breathing device air fill port and is the sole supply path for air to said first breathing device air fill port, wherein a second dedicated air supply line leads from said control panel to said second breathing device air fill port and is the sole supply path for air to said second breathing device air fill port, and wherein a third dedicated air supply line leads from said control panel to said third breathing device air fill port and is the sole supply path for air to said third breathing device air fill port.

10. The air delivery system in accordance with claim 1 wherein said at least one air supply control comprises a control valve corresponding to each of said dedicated air supply lines, each control valve configured to selectively control the flow of air from said main air supply line to said dedicated air supply line corresponding thereto independent of the other control valves and corresponding dedicated air supply lines.

* * * * *